US006796841B1

(12) United States Patent
Cheng et al.

(10) Patent No.: US 6,796,841 B1
(45) Date of Patent: Sep. 28, 2004

(54) ALLIGATOR CLIP WITH A FUSE HOLDER

(76) Inventors: Wen Tsung Cheng, No. 78 Chao-Chou St., Taoyuan (TW); Wen Ho Cheng, No. 78 Chao-Chou St., Taoyuan (TW)

( * ) Notice: Subject to any disclaimer, the term of this patent is extended or adjusted under 35 U.S.C. 154(b) by 9 days.

(21) Appl. No.: 10/423,961

(22) Filed: Apr. 28, 2003

(30) Foreign Application Priority Data

Mar. 7, 2003 (TW) ..... 92203528 U

(51) Int. Cl.[7] ..... H01R 13/68

(52) U.S. Cl. ..... 439/621; 439/759; 439/822; 439/829; 439/506

(58) Field of Search ..... 439/621, 622, 439/754, 822, 829, 759, 506, 504

(56) References Cited

U.S. PATENT DOCUMENTS 4,391,485 A * 7/1983 Urani ..... 439/687

FOREIGN PATENT DOCUMENTS

JP 10-59091 * 3/1998 ..... 439/621

* cited by examiner

*Primary Examiner*—Tho D. Ta

(57) ABSTRACT

An alligator clip with a fuse holder including a first clip member, a second clip member, and a resilient member is disclosed. The first and second clip members are connected to each other by a pivot pin. The resilient member is installed on the pivot pin and in contact against the interior surfaces of the first and second members. The front ends of the first and second clip members are used to clip the positive/negative electrode of the car battery. The first clip member has a lug extending from the bottom end thereof, which can be directly made by a stamp process. The lug is inserted within a housing of the fuse holder. The lug has a set of clip sheets to receive one pin of a fuse of the fuse holder. The other pin of the fuse is plugged into another set of clip sheets of another lug connected to a power cord.

3 Claims, 5 Drawing Sheets

ALLIGATOR CLIP WITH A FUSE HOLDER

BACKGROUND OF THE INVENTION

The present invention relates to an alligator clip with a fuse holder and, more particularly, the present invention relates to a clip structure used to clip a car battery having reduced cost and improved integral connection strength.

A typical alligator clip used to clip a car battery is illustrated in FIG. 1. The alligator clip includes a first clip member 10, a second clip member 11, a resilient member 12, a power cord 13 and a fuse holder 14. A pivot pin 101 is used to connect the first and second clip members 10 and 11. The resilient member 12 furnished on the pivot pin 101 allows the alligator clip capably to clip the positive/negative electrode of the car battery (not shown).

The power cord 13 has a first portion connected between a bottom end of the first clip member 10 and the fuse holder 14, and a second portion connected between the fuse holder 14 and the power source (not shown). That is, to incorporate the fuse holder 14 to avoid damaging the car battery due to overload, the power cord 13 is partitioned into the first and second portion.

The structure of the above conventional alligator clip partitions the power cord 13 into two parts to connect the respective ends of the fuse holder 14. Therefore, the fabrication cost may be increased, and the integral connection strength is deteriorated. Further, breakage is easily caused due to aging effect of the fuse holder 14, poor connectivity and overuse problems.

Therefore, the above alligator clip structure use to clip the car battery has drawbacks in practical application to be improved.

Having years of working experience in this particular field, the inventor has developed an improved alligator clip to resolve the drawbacks of the conventional alligator clip.

BRIEF SUMMARY OF THE INVENTION

The present invention provides an alligator clip with a fuse holder, which is suitable for use as a clipping tool for the car battery. A first clip member of the alligator clip is integrally formed to enhance the integral connection strength. Meanwhile, the fabrication cost can be reduced.

The alligator clip provided by the present invention comprises a first clip member, a second clip member, a resilient member and a fuse holder. A pivot pin is use to connect the first and the second clip members. On the pivot pin is a resilient member forcing the front ends of the first and second clip member to incline to each other, so as to perform clip function. Therefore, the alligator clip can connect to a positive/negative electrode of a car battery. The first clip member comprises a lug extending from a bottom end thereof and inserted in the fuse holder. The lug terminates with a set of clip sheets, to receive a pin of a fuse of the fuse holder. The fuse has another pin plugged in another set of clip sheets at one end of another lug. The other end of this another lug extends external to the fuse holder for connecting a power cord.

BRIEF DESCRIPTION OF THE DRAWINGS

These, as well as other features of the present invention, will become apparent upon reference to the drawings wherein.

DETAILED DESCRIPTION OF THE INVENTION

Figure 1:
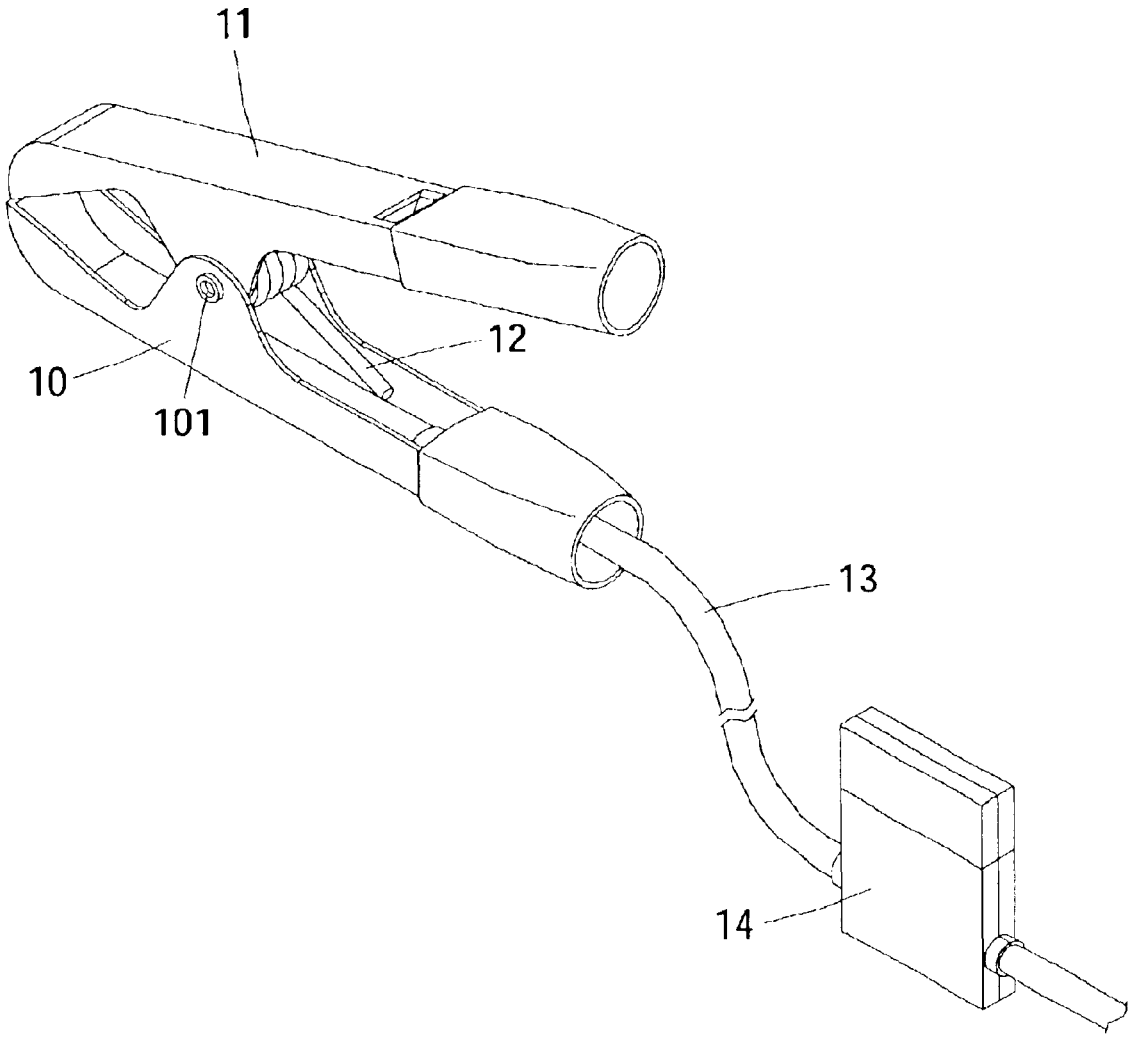
FIG. 1 PRIOR ART
FIG. 1 shows a perspective view of a conventional alligator clip used to connect a car battery.
Figure 2:
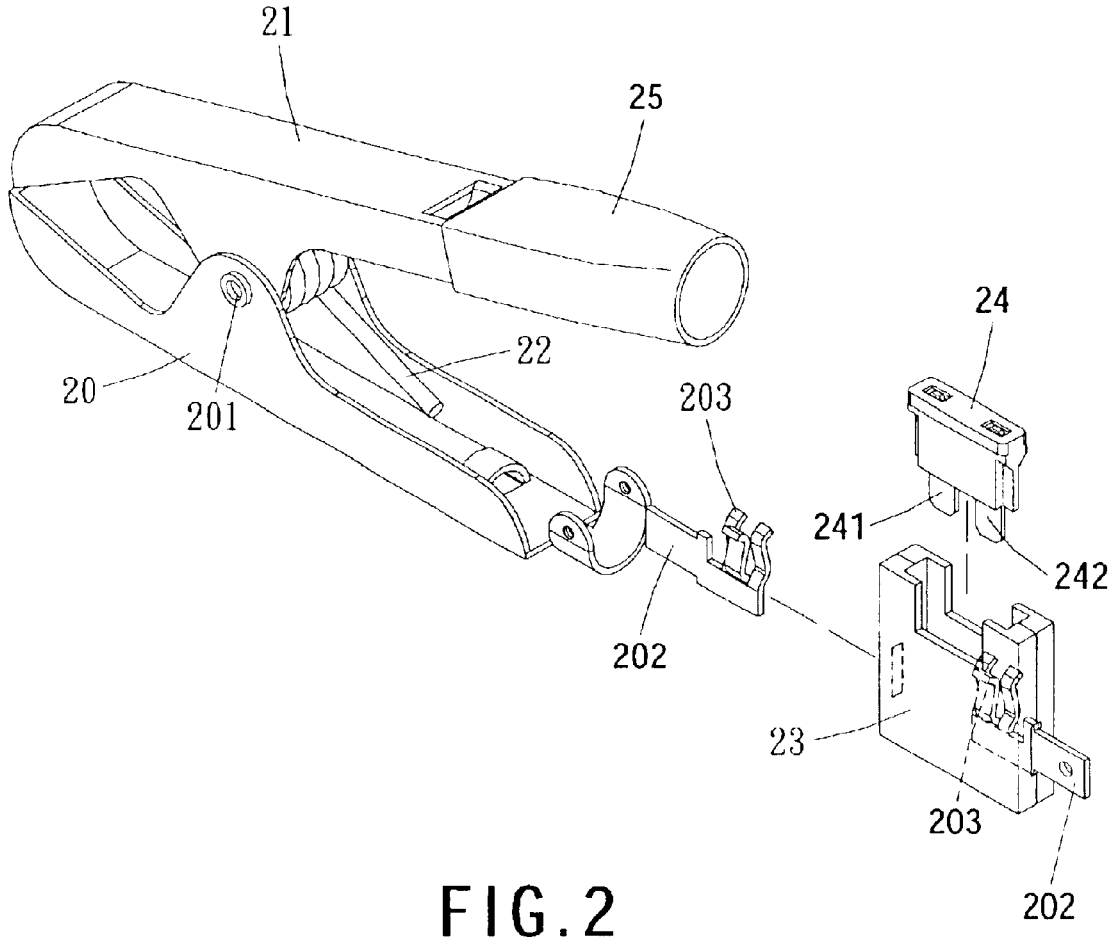
FIG. 2 shows an exploded view of an alligator clip in an embodiment of the present invention.
Figure 3:
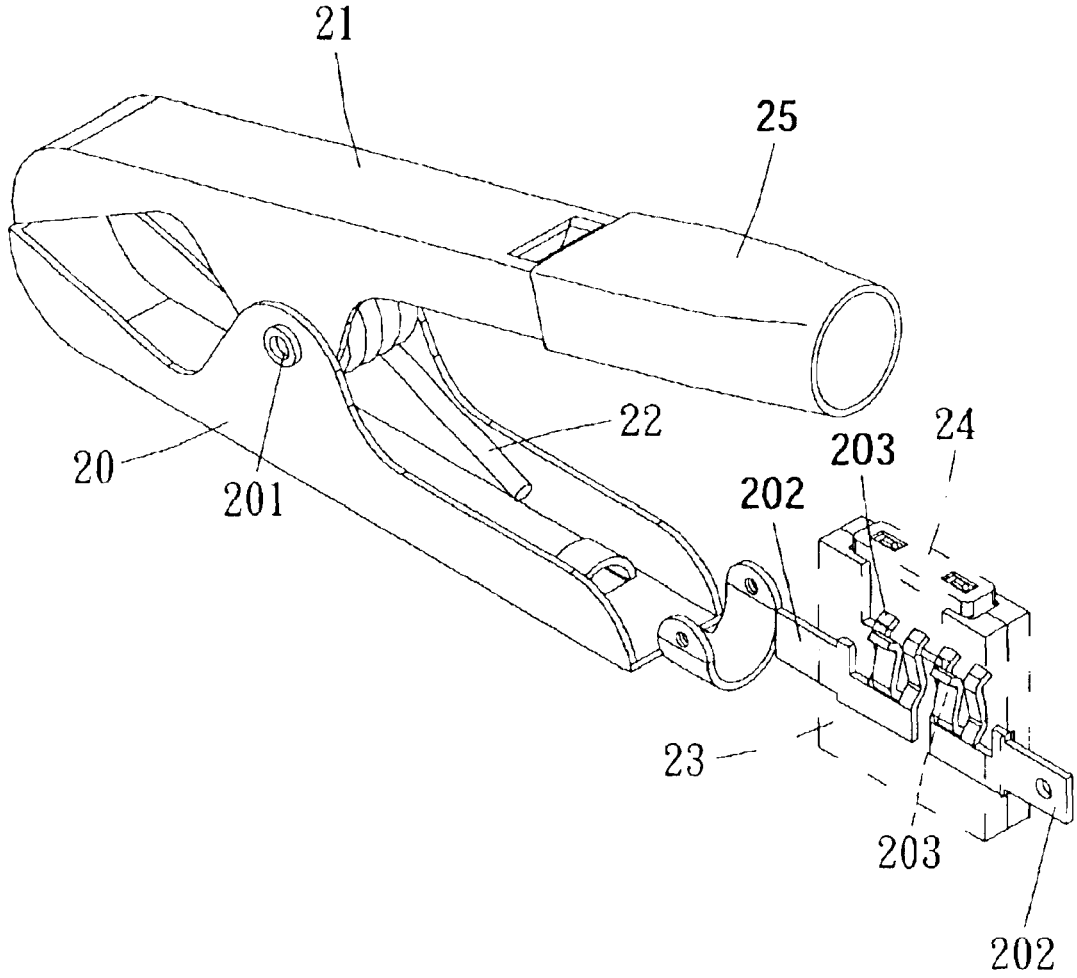
FIG. 3 is a cross sectional view showing the internal structure of the alligator clip after being connected with a fuse holder.

As shown in FIG. 2, the present invention provides an alligator clip with a fuse holder, particularly a kind of alligator clip used for connecting a car battery with reduced fabrication cost and enhanced integral connectivity. The alligator clip comprises a first clip member 20, a second clip member 21, a resilient member 22 and a fuse housing 23 of a fuse holder.

The first clip member 20 and the second clip member 21 are pivotally connected to each other by a pin 201. The alligator clip further comprises a resilient member 22 furnished on the pivot pin 201. The resilient member 22 has two opposite ends in contact against the interior surfaces of the first and second clip members 20 and 21. Thereby, the front ends of the first and second clip members 20 and 21 are inclined to each other to provide the clipping function, and the alligator clip can thus clip the positive/negative electrode of a car battery (not shown).

Figure 4:
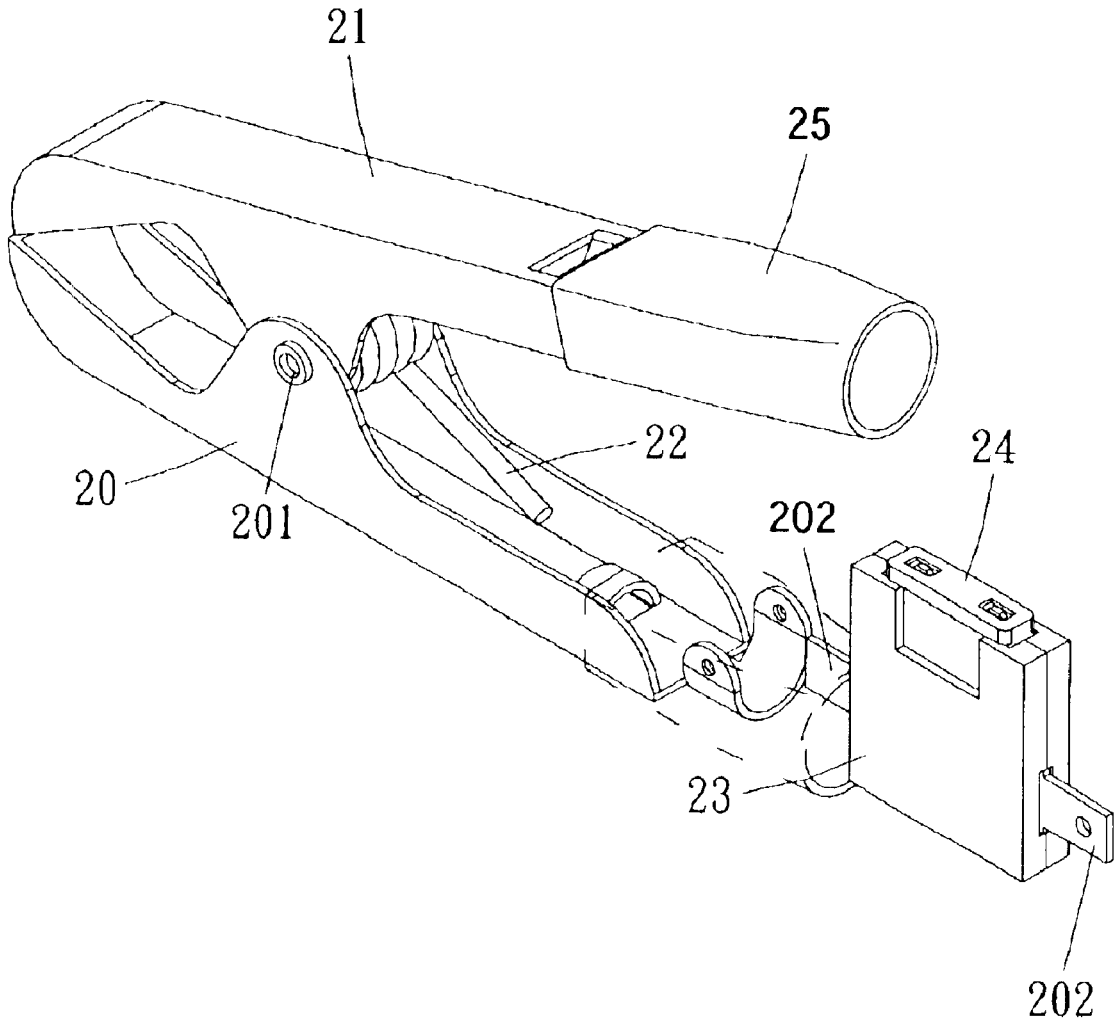
FIG. 4 shows a perspective view of the alligator clip assembly.
Figure 5:
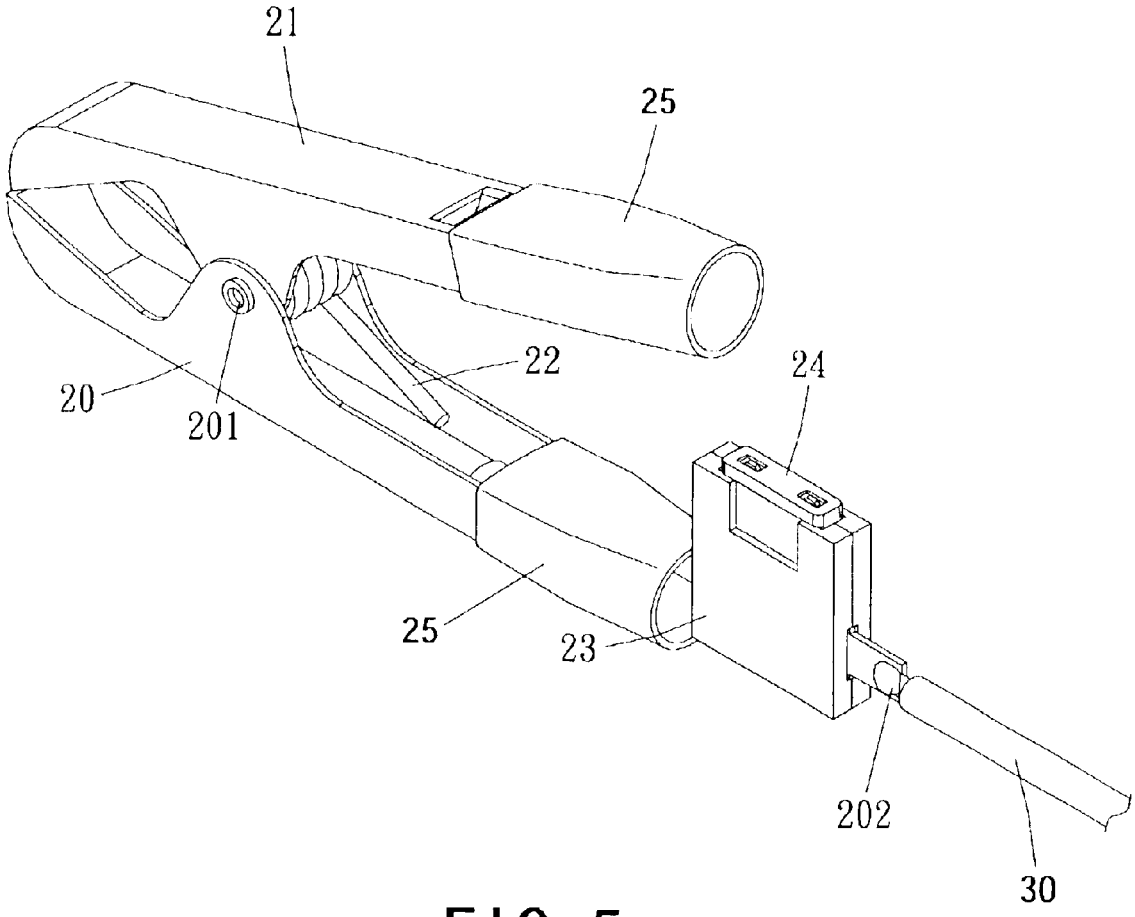
FIG. 5 shows the use condition of the alligator clip.

Referring to FIGS. 2–5, the first clip member 20 further comprises a lug 202 extending from a bottom end opposite to the front end thereof. The lug 202 is preferably formed by a stamp process, for example. The lug 202 is inserted into the fuse housing 23. Extending from the lug 202, there is a set of clip sheets 203 to receive one pin 242 of a fuse 24 of the fuse holder. As shown in FIG. 2, there is another set of clip sheets 203 extending from another lug 202 located inside the fuse housing 23 to receive the other pin 242 of the fuse 24. As shown in FIGS. 4 and 5, the another lug 202 protrudes from the fuse housing 23 to connecting a power cord 30. As the fuse 24 is installed between the car battery and the power cord 30, the damage of car battery caused due to overload can thus be prevented.

As shown in FIG. 5, the alligator clip further comprises a pair of insulator caps 25 enclosing the handling parts of the first or second clip members 20 or 21 for safety concern.

According to the above, the alligator clip provided by the present invention comprises at least the following advantages:

(1) The member for connecting the fuse holder is formed integrally with the alligator clip so that the connection strength is enhanced.

(2) The fabrication cost is effectively reduced.

This disclosure provides exemplary embodiments of a child safety blind. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed is:

1. An alligator clip with a fuse holder, comprising a first clip member and a second clip member connected to each other by a pivot pin, and a resilient member furnished on the pivot pin with two opposite ends in contact against respective surfaces of the first and second clip members so as to clip a positive/negative electrode of a car battery, the alligator clip being characterized by:

a first lug extending from a bottom end of the first clip member to be located inside a fuse housing of the fuse holder from a first side, comprising a set of clip sheets to receive one pin of a fuse of the fuse holder; and a second lug located inside the fuse housing, comprising a set of clip sheets to receive another pin of the fuse, the second lug extending through a second side of the fuse housing opposite to the first side for connecting a power cord.

2. The alligator clip according to claim 1, wherein the first lug is a stamped lug.

3. The alligator clip according to claim 1, further comprising an insulation cap mounted on the bottom end of the first clip to enclose the first lug.

* * * * *